US007614167B2

(12) United States Patent
Klavano

(10) Patent No.: US 7,614,167 B2
(45) Date of Patent: Nov. 10, 2009

(54) MASSAGE SANDALS

(75) Inventor: James Kenneth Klavano, Sammamish, WA (US)

(73) Assignee: Australia Unlimited, Inc., Kent, WA (US)

( * ) Notice: Subject to any disclaimer, the term of this patent is extended or adjusted under 35 U.S.C. 154(b) by 395 days.

(21) Appl. No.: 11/495,170

(22) Filed: Jul. 28, 2006

(65) Prior Publication Data

US 2008/0022561 A1 Jan. 31, 2008

(51) Int. Cl.
*A61F 5/14* (2006.01)
*A43B 3/12* (2006.01)

(52) U.S. Cl. ..... 36/141; 36/11.5; 36/30 R

(58) Field of Classification Search ..... 36/141, 36/11.5, 25 R, 30 R, 43, 44
See application file for complete search history.

(56) References Cited

U.S. PATENT DOCUMENTS

| | | | | |
|---|---|---|---|---|
| 3,722,113 | A | 3/1973 | Birkenstock | |
| 3,757,774 | A | 9/1973 | Hatuno | |
| 3,859,727 | A | 1/1975 | Nakamoto | |
| 3,885,555 | A | 5/1975 | Nobbs | |
| 4,095,353 | A | 6/1978 | Foldes | |
| D250,738 | S | 1/1979 | Foldes | |
| D278,571 | S | 4/1985 | Eber | |
| 4,727,661 | A * | 3/1988 | Kuhn | 36/100 |
| 5,322,056 | A | 6/1994 | Menghi et al. | |
| 5,400,526 | A * | 3/1995 | Sessa | 36/3 B |
| 5,694,705 | A * | 12/1997 | Alonso Coves | 36/44 |
| 5,860,229 | A * | 1/1999 | Morgenstern | 36/141 |
| 6,038,790 | A * | 3/2000 | Pyle et al. | 36/30 R |
| 6,857,202 | B2 * | 2/2005 | Pfander | 36/3 R |
| 6,951,066 | B2 * | 10/2005 | Snow | 36/29 |
| 2002/0088140 | A1 * | 7/2002 | Wang et al. | 36/3 B |
| 2004/0118015 | A1 * | 6/2004 | Lai | 36/3 B |
| 2008/0022561 | A1 * | 1/2008 | Klavano | 36/141 |

OTHER PUBLICATIONS

Verdejo, R., and N.J. Mills, "Heel-Shoe Interactions and the Durability of EVA Foam Running-Shoe Midsoles," *Journal of Biomechanics 37*(9):1379-86, Sep. 2004.

* cited by examiner

*Primary Examiner*—Ted Kavanaugh
(74) *Attorney, Agent, or Firm*—Christensen O'Connor Johnson Kindness PLLC

(57) ABSTRACT

A sandal (100) is disclosed having a relatively rugged bottom sole (102), the may be formed form a thermoplastic rubber, a relatively thick middle sole (120), that may be formed from an ethylene vinyl acetate foam, and a massaging upper sole (130) that may be formed form a polyurethane/latex blend. The upper sole includes a large plurality of upright fingers 134) generally having rounded top surface, providing a massaging action during use. A strap assembly (400) is provided, that may be attached between the upper sole and the middle sole. In an embodiment of the sandal, a crushable foam layer (125) is disposed between the middle layer and the upper layer, providing additional resiliency especially during the initial usage of the sandal.

8 Claims, 4 Drawing Sheets

MASSAGE SANDALS

BACKGROUND

Many people find that a foot massage can relieve stress and promote a feeling of relaxation. It is believed that massaging the foot targets other regions of the body, stimulating internal organs and improving circulation. Why does a foot massage feel so good? The answer may lie in reflexology, a zone therapy that seeks to correct imbalances in the body by stimulating corresponding areas of the foot. For example, it is believed that proper stimulation of the foot can, among other benefits, enhance circulation and generally reduce fatigue in the legs and lower back. However, whatever the source or mechanism of the benefits from foot massages, this popular therapy has provided comfort and energy to many people over the years.

Massaging sandals, generally sandals having a footpad with a number of upright elastic projections or nodules positioned to engage the bottom surface of the wearer's foot, are known in the art. Examples of massaging sandals are disclosed, for example, in U.S. Pat. No. 3,722,113 to Birkenstock, U.S. Pat. No. 3,757,774 to Hatuno, U.S. Pat. No. 4,095,353 to Foldes and U.S. Pat. No. 5,322,056 to Menghi et al.

Typically, prior art massaging sandals are formed from a unitary footpad with one or more straps that may or may not be unitarily formed with the footpad. While prior art massaging sandals have been found effective for many users, certain disadvantages may be noted from such prior art constructions. For example, the footpad massaging nodules may be too hard and/or too rigid to be comfortable to the user. It will be appreciated that a wearer using a massaging sandal intermittently supports their entire weight on the footbed nodules. Therefore, if the nodules are too hard, the experience may cause discomfort to the wearer, especially to a new wearer who is not accustomed to the sandals. To compensate for such hardness the nodules may be made too large and/or flat to provide the desired massaging stimulation. Alternatively, if a softer, more resilient material is used for the sandal footbed in order to optimized the performance of the massaging nodules, the sandal may exhibit wear too rapidly.

As alluded to above, a wearer's foot may initially be overly sensitive to the pressures imposed by the pliable nodules of a massaging sandal. After a wearer's foot becomes more accustomed and desensitized to the massaging actions of the nodules, it may be preferable to have less pliability in the footbed, to increase the intensity of the massaging action.

The present invention overcomes the disadvantages associated with many prior art massaging sandals.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a current embodiment, the massaging sandal includes a skid-resistant bottom sole, that may be molded, for example, from a thermoplastic rubber. A middle sole is attached to the bottom sole, for example with an adhesive. The middle sole is molded from a pliable elastic material, for example an ethylene vinyl acetate foam, and provides cushioning for the user, and conforms to the user's foot over time. A massaging upper layer is affixed to the middle layer, and has a number of upright fingers that provide a massaging action to the user's foot during use. The upper layer may be molded from having a polyurethane/latex material having sufficient rigidity to support the user's foot during use, while also being flexible enough to provide the desired massaging action. The fingers may have differing lengths, to approximately match the typical shape of the bottom of a user's foot. A strap assembly is fixedly attached to the middle sole.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The present invention overcomes disadvantages of prior art massaging sandals by recognizing that the massaging sandal presents several competing objectives in optimizing a massaging sandal. For example, it is desirable that the sandal be relatively light weight and comfortable. It is desirable that the outsole, or bottom portion of the sandal be strong and durable to avoid excessive wear, while having sufficient grip to inhibit slipping or skidding during use, and be sufficiently flexible to accommodate comfortable walking. The massaging upper portion of the sole includes upstanding nodules or fingers that are preferably of sufficient rigidity to provide a massaging action, without being too uncomfortable to the user. It is also desirable that the fingers of the upper portion be sufficiently stiff in the axial direction to collectively support the user's foot, while also preferably provide a cushioning action in the vertical direction. It may also be desirable in the case of massaging sandals that the vigor of the massaging action increase as the user becomes more accustomed to the massaging action of the sandals.

Figure 1:
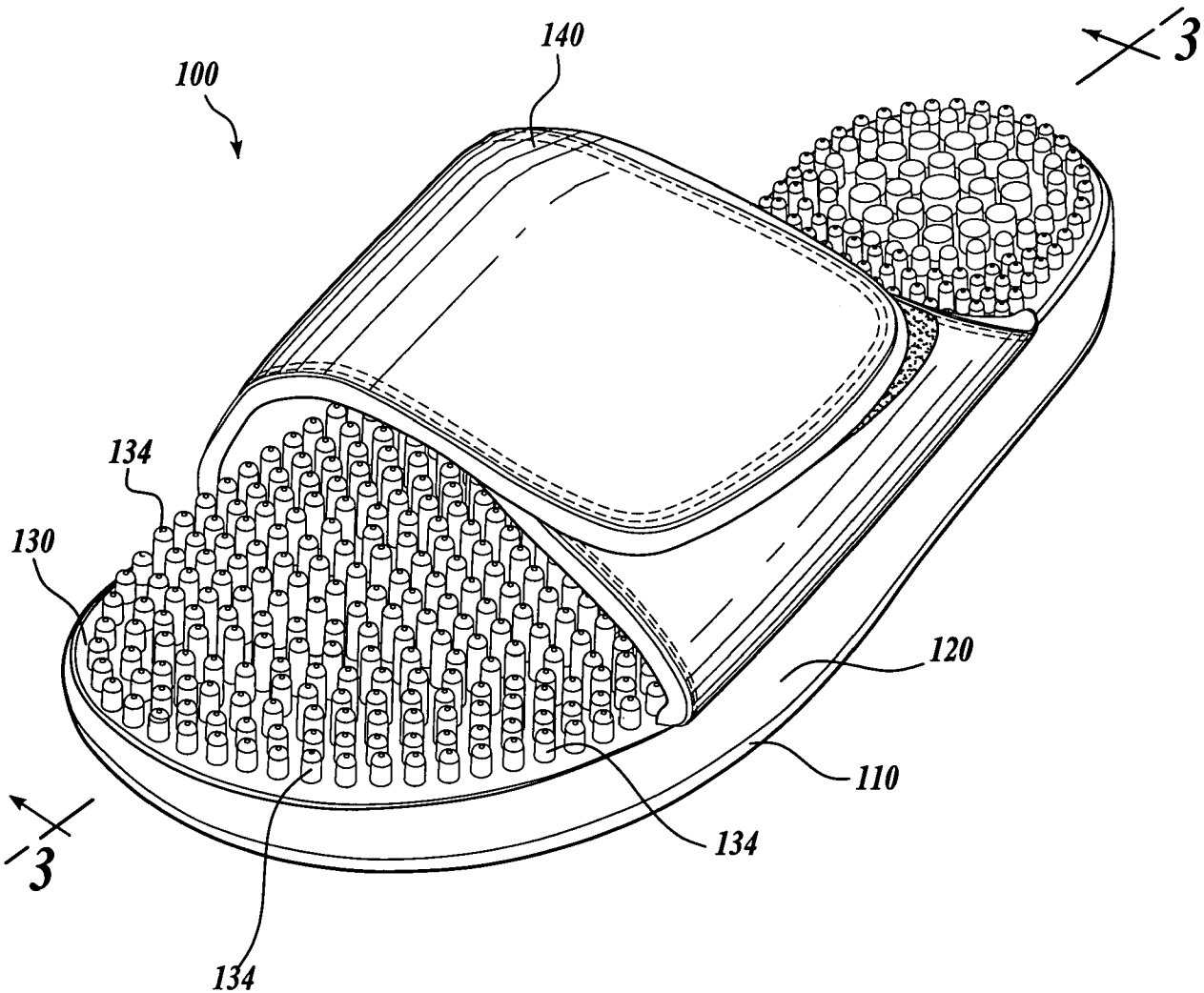
FIG. 1 shows a perspective view of a massaging sandal made in accordance with the teachings of the present invention.
Figure 2:
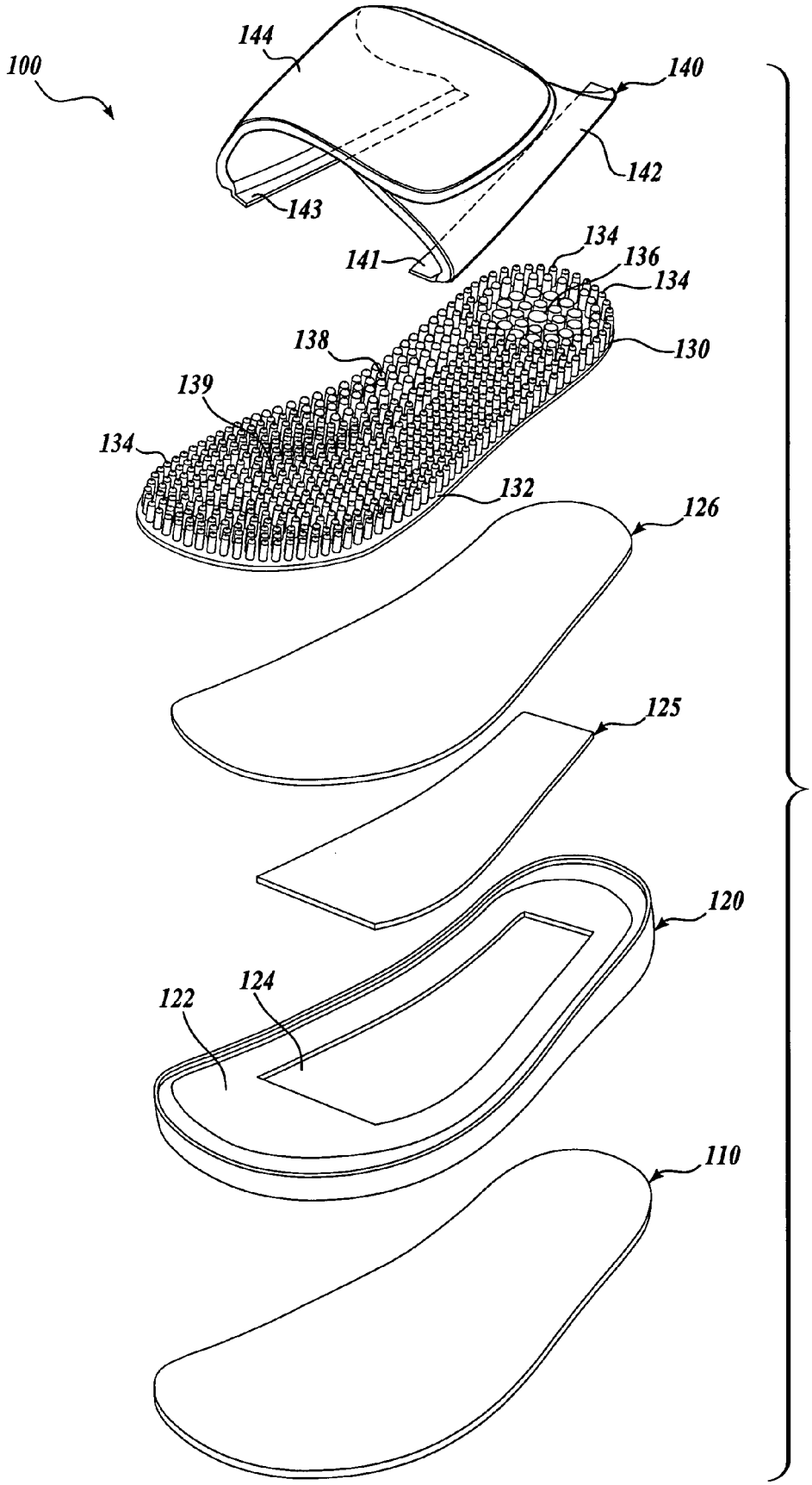
FIG. 2 shows an exploded view of the massaging sandal shown in FIG. 1.
Figure 3:
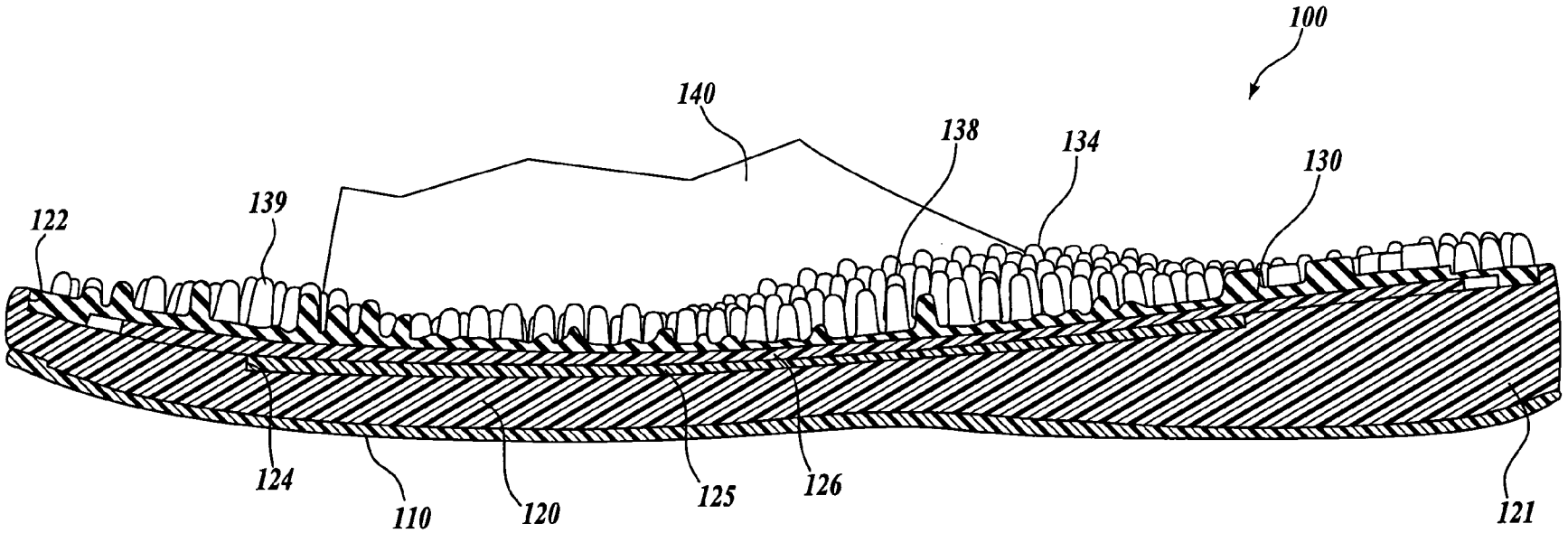
FIG. 3 shows a cross-sectional view of the massaging sandal shown in FIG. 1, generally through section 3-3.

Refer now to FIG. 1, which shows a perspective view of a massaging sandal 100 made in accordance with the present invention. Refer also to FIG. 2, showing an exploded view of the massaging sandal 100, and to FIG. 3, showing a cross-sectional view of the massaging sandal 100, generally through section 3-3 in FIG. 1.

The massaging sandal 100 defines a foot bed having a relatively rugged, ground-engaging bottom sole 110. The bottom sole 110 is relatively thin, and is flexible and relatively light. The bottom sole 110 is made from a material selected for toughness, wearability and skid resistance. In the current embodiment, the bottom sole 110 is formed from a thermoplastic rubber ("TPR"). Thermoplastic rubber combines the ease of processing or workability of plastics with the resiliency and durability of rubbers, and are typically lighter weight than suitable alternative materials. Suitable TPRs also provide good gripping properties, to help reduce slipping and skidding during use. It is contemplated that a polypropylene-based thermoplastic rubber or rubber blend, for example, would be suitable for the lower sole 110. Of course, the bottom sole typically will also be formed with texturing and/or tread-like structures to further improve skid resistance, improve comfort and provide a more aesthetically pleasing product. It will be appreciated that by forming the bottom sole 110 as a relatively thin outsole, the flexibility of the sandal 100 is retained, and the total weight of the sandal is not too great. It is also contemplated that the bottom sole 100 thickness may vary, such that the sandal 100 flexes preferentially at desired locations, for example in the metatarsal region of the foot.

A relatively thick middle sole 120 is attached to the bottom sole 110, for example by adhesively bonding, or co-molding the middle sole 120 with the bottom sole 110. In the current embodiment the middle sole 120 is formed from an ethylene vinyl acetate ("EVA") foam, which is less dense than the bottom sole 110. The middle sole 120 is relatively elastic, compressible, and soft, as compared to the bottom sole 110, thereby providing a comfortable cushion.

Additionally, a particular advantage to using a conformable material such as the EVA foam is that the overall shape of the middle sole 120 will conform over time to the general shape of the wearer's foot, accommodating to the forces exerted by the user, for example during walking. However, it is desirable to avoid excessive movement of material away from the center portion of the sole over time, a process sometimes referred to in the industry as "boating." In boating, the material tends to move generally towards the toe and heel regions, resulting in a thin center portion. By affixing or otherwise permanently adhering the middle sole 120 to the more dimensionally stable bottom sole 110, as disclosed herein, the middle sole 120 will conform to the user, without significant boating.

This combination provides a massaging sandal 100 that becomes more comfortable over time, as the middle sole 120 gradually adjusts to the particular user's foot and pattern of walking, and without excessive boating. In a current embodiment, the middle sole 120 is thicker near the rearward, or heel portion 121 of the middle sole 120. The heel portion 121 of the middle sole 120 experiences the greatest loads, and therefore it is advantageous to use a thicker middle layer in that region to provide improved shock absorption for user comfort, and to allow for greater conformability over time.

As seen most clearly in FIGS. 3 and 4 the middle sole 120 in the current embodiment is formed to include a recess 122 along the upper surface, which is sized and positioned to accept the massaging upper sole 130, as discussed below.

The massaging sandal 100 optionally includes one or more intermediate crushable foam layers 125, 126 (two shown) disposed in the recess 122 of the middle sole 120, and may be attached thereto, for example, by adhesive bonding or ultrasonic welding. Alternatively, the crushable foam layers 125, 126 may be simply placed in the recess 122, and retained there by other of the sole components. The intermediate foam layers 125, 126 are preferably a light-weight polymeric foam material that exhibits some resiliency during use, but will eventually be substantially crushed through use, such that the cushioning effect of the intermediate foam layers 125, 126 will diminish. A second recess 124 may be provided in the middle sole 120 to accommodate one or more of the intermediate foam layers 125, 126.

A massaging upper sole 130 is disposed in the recess 122 of the middle sole 120, overlying the intermediate foam layers 125, 126, and extends upwardly from the middle sole 120. The massaging upper sole 130 includes a base portion 132 disposed generally in the recess 122, and a large number of fingers 134 that project upwardly from the base portion 132. In a current embodiment, the upper sole 130 includes more than one hundred fingers 134. The fingers 134 may be generally rounded at the top, or may flatten out, to have a generally cylindrical shape. For example, in a particular embodiment, an island 136 of fingers 134 are provide near the heel region with a generally flattened upper end, thereby better accommodating the peak forces generated at the heel during walking. It will also be appreciated that the fingers 134 may be of differing heights, to better conform to the shape of the user's foot. For example, the fingers 134 near the medial instep portion 138 of the upper sole 130, and the fingers 134 near the front side of the metatarsal region 139 may be longer, such that the fingers 134 extend to the relevant areas of the user's foot during normal walking. The upper sole 130 may also include a recess (not shown) in the bottom face to accommodate the intermediate foam layers 125, 126. It will be appreciated, therefore, that the tops of the fingers 134 generally define a contoured upper surface that is adapted to the general shape of a user's foot.

The fingers 134, of course, provide the massaging action to the user's foot, and therefore it is desirable that the fingers 134 be sufficiently elastic to provide the massaging action. The desired material properties will depend on the particular application as well as the number, location and particular shape of the fingers 134. It is considered to be within the skill in the art to design fingers 134 having desirable elastic properties. In the current embodiment, the upper sole 130 is molded from a polyurethane/latex blend, and may be attached to the middle sole 120 by adhesive bonding, or by any other method as are known in the art.

A strap assembly 140 may be attached to the footpad by any convenient method. In the preferred embodiment, the strap assembly 140 comprises lateral and medial straps 142, 144 that each include a include a tab portion 141, 143 that is inserted under the upper sole 130 during assembly, prior to attaching the upper sole 130 to the middle sole 120. The lateral and medial straps 142, 144 are then adhered to the middle sole 120 concurrently with, or prior to, attachment of the upper sole 130. It will be apparent that alternate attachment mechanisms may be used, without departing from the present invention, including for example stitching, co-molding, and the like. Similarly, the lateral and medial straps 142, 144 may be formed as a unitary piece, with a connecting portion extending transversely across the width of the sandal. The lateral and medial straps 142, 144 include cooperative attachment mechanisms, for example hook and loop type fasteners 145 such as Velcro™, to facilitate appropriate adjustment and securement of the strap assembly 140.

Figure 4:
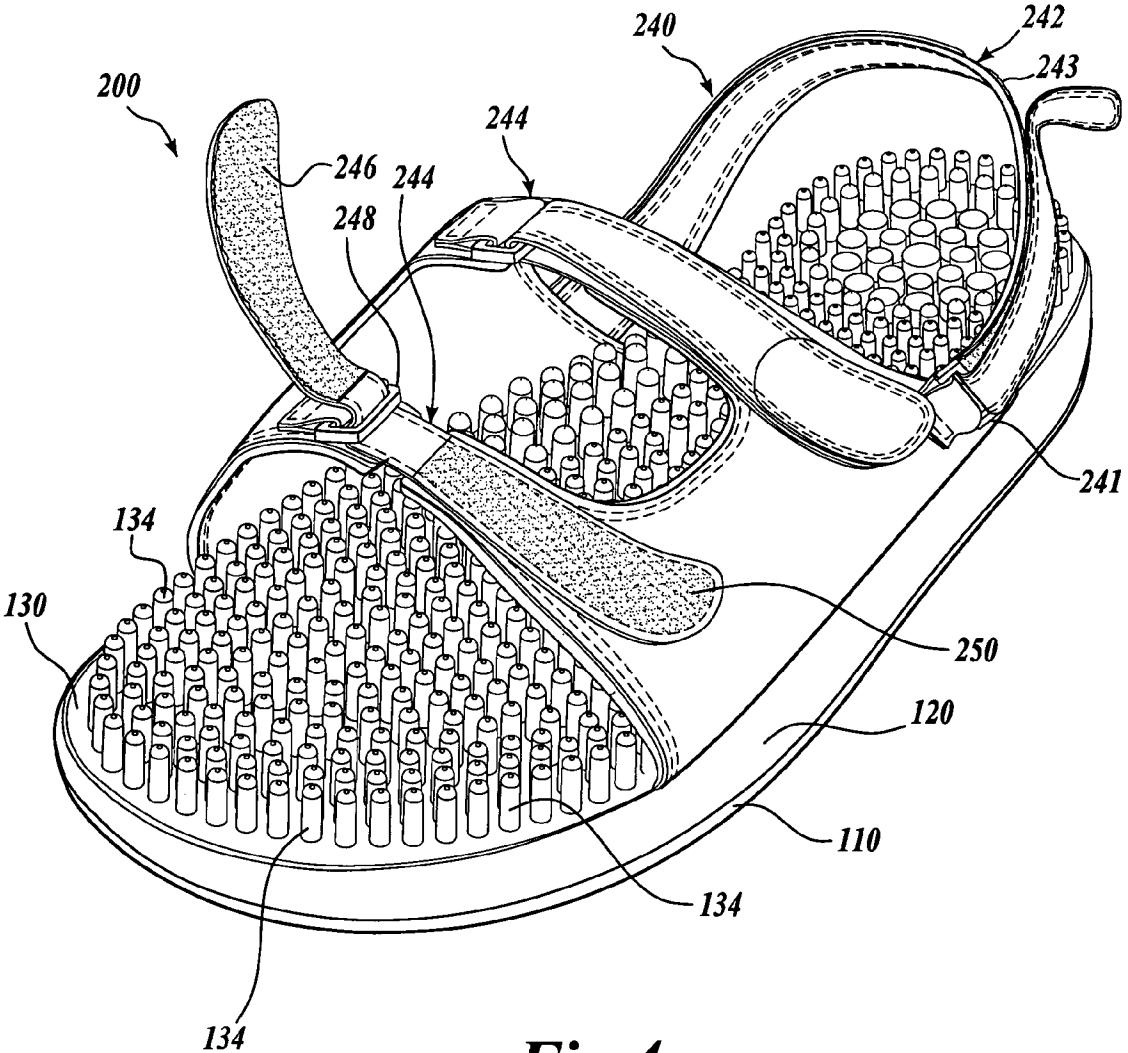
FIG. 4 shows a perspective view of an alternative embodiment of a massaging sandal in accordance with the present invention.

Refer now to FIG. 4, which shows an alternative embodiment of a massaging sandal 200 according to the present invention. The massaging sandal 200 is similar to the massaging sandal 100 described above, including a skid-resistant bottom sole 110, a resilient middle sole 120, and a massaging upper sole 130, with a plurality of upright fingers 134. Therefore aspects of this second embodiment that are generally the same as the previous embodiment will not be repeated here, for brevity and clarity.

The sandal 200 includes a strap assembly 240 that includes a heel loop portion 242 that adjustably extends behind the heel of a user, to hold the sandal 200 more closely to the user's foot, and for additional comfort. The heel loop portion 242 may be inserted through a loop 241, and return to releasably attach to the heel loop portion 242, for example with a hook and loop type fastener 243. The strap assembly also includes one or more narrow straps 244 (two shown) that extend over the user's instep, and may include a distal portion 246 that is inserted through a loop or keeper 248, and releasably attaches to itself, for example using a hook and loop type fastener 250.

It is believed to be well within the skill in the art to utilize any number of other strap designs, without departing from the present invention.

While illustrative embodiments have been illustrated and described, it will be appreciated that various changes can be made therein without departing from the spirit and scope of the invention.

The invention claimed is:

1. A massaging sandal comprising:

a skid-resistant bottom sole;

a middle sole fixedly attached to the bottom sole, the middle sole comprising a conformable polymeric foam;

a massaging upper layer having a base portion that is fixedly attached to the middle sole, and a plurality of upwardly extending, elastic fingers having differing heights wherein a first portion of the elastic fingers disposed in a medial instep region of the upper layer and a second portion of the elastic fingers disposed in a metatarsal region of the upper layer are longer than a third portion of the elastic fingers disposed away from the medial instep region and away from the metatarsal region;

an intermediate foam layer disposed between the middle sole and the upper layer and comprising a crushable polymeric foam; and a strap assembly fixedly attached to the middle sole.

2. The massaging sandal of claim 1, wherein the middle sole includes a recess in an upper face of the middle sole, and further wherein the massaging upper layer is disposed in the recess.

3. The massaging sandal of claim 2, wherein the middle sole is formed from an ethylene vinyl acetate foam.

4. The massaging sandal of claim 1, wherein the bottom sole is formed from a thermoplastic rubber.

5. The massaging sandal of claim 1, wherein the fingers have a curved upper end.

6. The massaging sandal of claim 1, wherein the fingers define a contoured upper surface that is adapted to generally conforms the shape of a user's foot.

7. The massaging sandal of claim 1, wherein the upper layer is formed from a polyurethane-latex blend.

8. The massaging sandal of claim 1, wherein the strap assembly comprises a lateral strap and a medial strap, and wherein lateral and medial straps include tab portions that extend between the upper layer and the middle sole.

* * * * *

UNITED STATES PATENT AND TRADEMARK OFFICE

CERTIFICATE OF CORRECTION

PATENT NO. : 7,614,167 B2
APPLICATION NO. : 11/495170
DATED : November 10, 2009
INVENTOR(S) : J. K. Klavano It is certified that error appears in the above-identified patent and that said Letters Patent is hereby corrected as shown below:

| COLUMN | LINE | ERROR |
|---|---|---|
| (57) Pg. 1, col. 2 | Abstract 2 of text | "the may be" should read --that may be-- |
| (57) Pg. 1, col. 2 | Abstract 2 of text | "formed form" should read --formed from-- |
| 6 (Claim 6, | 17 line 2) | "conforms" should read --conform to-- |

Signed and Sealed this

Thirteenth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,614,167 B2
APPLICATION NO. : 11/495170
DATED : November 10, 2009
INVENTOR(S) : James Kenneth Klavano It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 500 days.

Signed and Sealed this

Nineteenth Day of October, 2010

David J. Kappos

David J. Kappos
*Director of the United States Patent and Trademark Office*